US009343843B2

(12) United States Patent
Guo

(10) Patent No.: US 9,343,843 B2
(45) Date of Patent: May 17, 2016

(54) WATERPROOF ELECTRICAL CONNECTOR

(71) Applicant: FOXCONN INTERCONNECT TECHNOLOGY LIMITED, Grand Cayman (KY)

(72) Inventor: Jing-Jie Guo, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/603,298

(22) Filed: Jan. 22, 2015

(65) Prior Publication Data

US 2015/0207262 A1 Jul. 23, 2015

(30) Foreign Application Priority Data

Jan. 22, 2014 (CN) ..... 2014 2 0038908 U

(51) Int. Cl.

| | |
|---|---|
| ***H01R 9/03*** | (2006.01) |
| ***H01R 13/52*** | (2006.01) |
| *H01R 13/6598* | (2011.01) |
| *H01R 24/62* | (2011.01) |

(52) U.S. Cl.

CPC ..... *H01R 13/5216* (2013.01); *H01R 13/5202* (2013.01); *H01R 13/6598* (2013.01); *H01R 24/62* (2013.01)

(58) Field of Classification Search

CPC ..... H01R 13/658
USPC ..... 439/607.58, 607.51, 736
See application file for complete search history.

(56) References Cited

U.S. PATENT DOCUMENTS

| | | | | |
|---|---|---|---|---|
| 4,585,292 | A * | 4/1986 | Frantz | H01R 9/032 439/607.47 |
| 5,108,317 | A * | 4/1992 | Beinhaur | H01R 43/24 264/274 |
| 7,284,634 | B2 * | 10/2007 | Tatewaki | B62D 5/0424 180/443 |
| 7,341,487 | B2 * | 3/2008 | Wu | H01R 13/6658 439/497 |
| 7,625,236 | B1 * | 12/2009 | Wu | H01R 24/62 439/607.58 |
| 8,662,928 | B1 * | 3/2014 | Xie | H01R 13/6594 439/607.35 |
| 9,106,824 | B2 * | 8/2015 | Endo | H04N 5/23212 |
| 9,112,289 | B1 * | 8/2015 | Lin | H01R 9/28 |
| 9,160,098 | B1 * | 10/2015 | Liao | H01R 13/5202 |
| 2014/0357124 | A1 * | 12/2014 | Zhao | H01R 13/405 439/607.55 |
| 2015/0207257 | A1 * | 7/2015 | Dai | H01R 13/405 439/660 |

FOREIGN PATENT DOCUMENTS

| | | |
|---|---|---|
| CN | 101896645 | 11/2010 |
| CN | 102044776 | 5/2011 |

* cited by examiner

*Primary Examiner* — Phuong Dinh
(74) *Attorney, Agent, or Firm* — Wei Te Chung; Ming Chieh Chang

(57) ABSTRACT

An electrical connector (100) includes an insulative housing (1), a number of contacts (2) retained in the insulative housing, a metal shell (4) covering the insulative housing, and an insulative cover (5) molded over the metal shell and integral with the insulative housing. A diffusion layer (6) is formed between the metal shell and the insulative cover. Chemical reaction is generated from metal and resin in the diffusion layer.

17 Claims, 6 Drawing Sheets

WATERPROOF ELECTRICAL CONNECTOR

BACKGROUND OF THE INVENTION

1. Field of the Invention

The present invention relates generally to an electrical connector, and more particularly to an electrical connector having a better waterproof performance.

2. Description of Related Arts

China Pat. No. 102044776 discloses both an electrical connector and a manufacturing method of the electrical connector. Because metal and resin are not completely combined, there is still interspace therebetween, as well as between the contacts and the insulative body, even though the insulative body is molded over the metal shell and the contacts.

China Pat. No. 101896645 discloses a resin-metal bonded body of an aluminum metal member and a thermoplastic resin member, which has improved bonding strength and good durability. The aluminum metal member and the thermoplastic resin member are bonded together by an anodic oxide coating having a film thickness of 70-1500 nm or an anodic oxide coating having a triazine thiol in the inner and upper portions. The anodic oxide coating has an infrared absorption spectrum peak intensity ascribed to OH group at 0.0001-0.16.

U.S. Pat. No. 7,284,634 discloses a resin-metal composite technology: TRI Composite Technology. The TRI Composite Technology is a technology of joining plastic to a metal such as an aluminum alloy, a copper alloy etc within the metal mold by chemical coupling or by bonding chemically, which involves applying an electrochemical special metal surface treatment and insert injection molding. This technology provides firm joining without using any adhesive or bonding agent and is therefore capable of designing minute parts.

An electrical connector having a better waterproof performance is desired.

SUMMARY OF THE INVENTION

Accordingly, an object of the present invention is to provide an electrical connector having a better waterproof performance.

To achieve the above object, an electrical connector includes an insulative housing, a number of contacts retained in the insulative housing, a metal shell covering the insulative housing, and an insulative cover molded over the metal shell and integral with the insulative housing. A diffusion layer is formed between the metal shell and the insulative cover. Chemical reaction is generated from metal and resin in the diffusion layer. Via the diffusion layer, the whole connector may be made via a one shot insert-molding process without risks of separation between the metal parts and the resin.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 5:
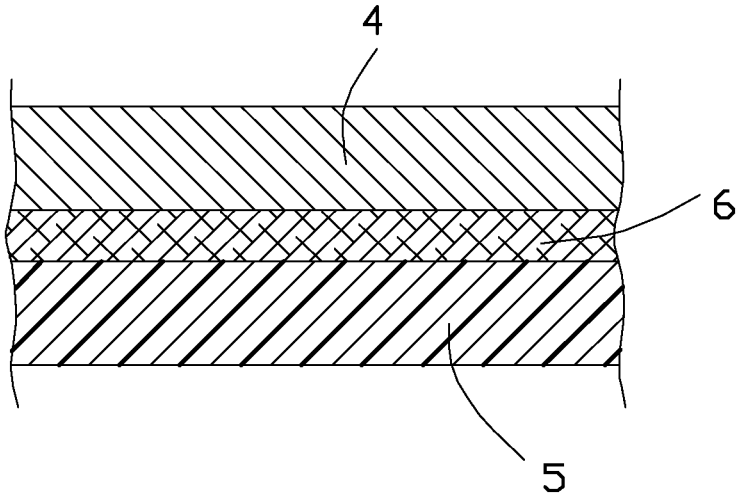
FIG. 5 is a schematic view of a diffusion layer between a metal layer and a resin layer.
Figure 6:
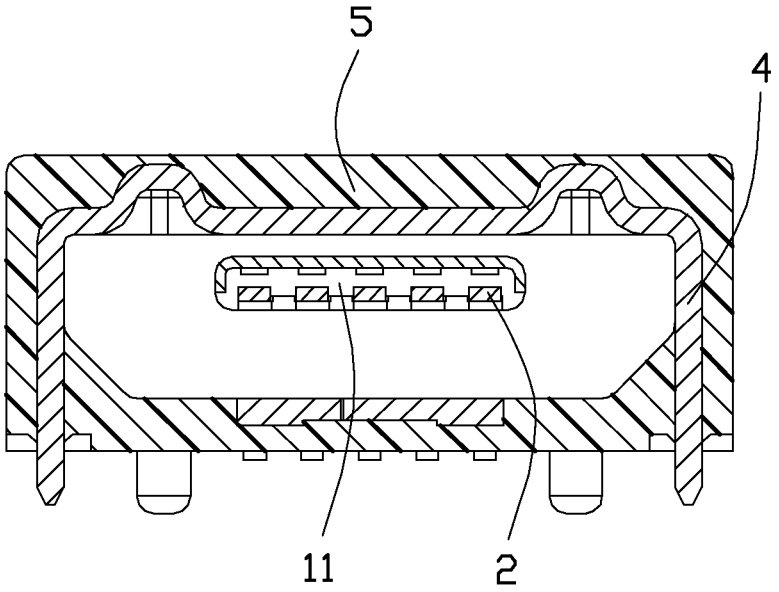
FIG. 6 is a cross-sectional view of the electrical connector of FIG. 1, taken along line 6-6.

Referring to FIGS. 1-6, an electrical connector 100 of the present invention, comprises an insulative housing 1, a plurality of contacts 2 and a reinforcing metal plate 3 retained in the insulative housing 1, a metal shell 4 defining therein a receiving space 44 and covering the insulative housing 1, and an insulative cover 5 molded over the metal shell 4. The insulative cover 5 is integral with the insulative housing 1. Each contact 2 has a retaining portion 21 retained in the insulative housing 1. In manufacturing, the contacts 2, the reinforcing metal plate 3, and the metal shell 4 are oriented by a plurality of molds (not shown), resin is filled into the molds and flows to integrally form the insulative housing 1 and the insulative cover 5. An electrochemical special metal surface treatment is implemented on the reinforcing metal plate 3, the metal shell 4, and the retaining portions 21 of the contacts 2 before insert injection molding. A metal-plastic composite technology, for instance, as by TRI Composite Technology by Toa Denka and Tohno Seimitsu Co. Inc., is generated between metal and resin. Therefore, metal and resin diffuse into each other to form a diffusion layer 6. Referring to FIG. 5, the diffusion layer 6 is formed between the metal shell 4 and the insulative cover 5, which is not limiting but is descriptive of depiction. The diffusion layer 6 is also formed between the contacts 2 and the insulative housing 1, between the reinforcing metal plate 3 and the insulative housing 1, between the reinforcing metal plate 3 and the insulative cover 5, and between the metal shell 4 and the insulative housing 1.

Because the diffusion layer 6 is formed by chemical reaction generated between metal and resin, and so, the diffusion layer 6 is very rigid and high density to have a better waterproof performance. Therefore, water is effectively prevented from entering into an interior of an electronic appliance (not shown) which the electrical connector 100 of the present invention is assembled on.

Figure 1:
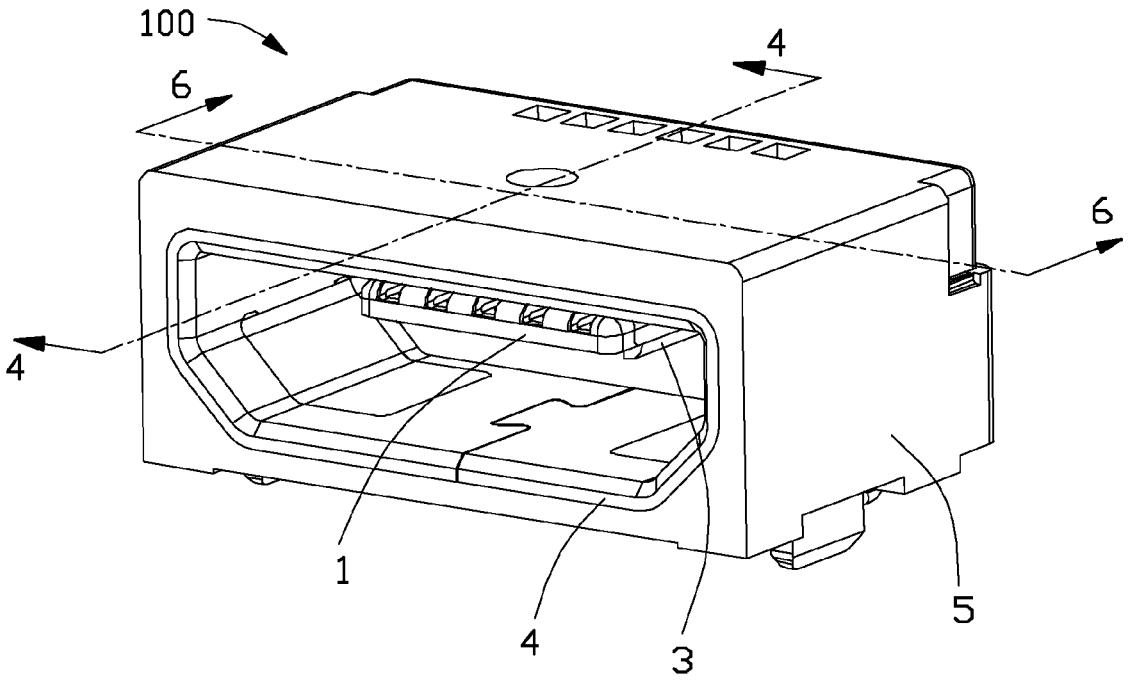
FIG. 1 is a perspective, assembled view of an electrical connector constructed in accordance with the present invention.
Figure 2:
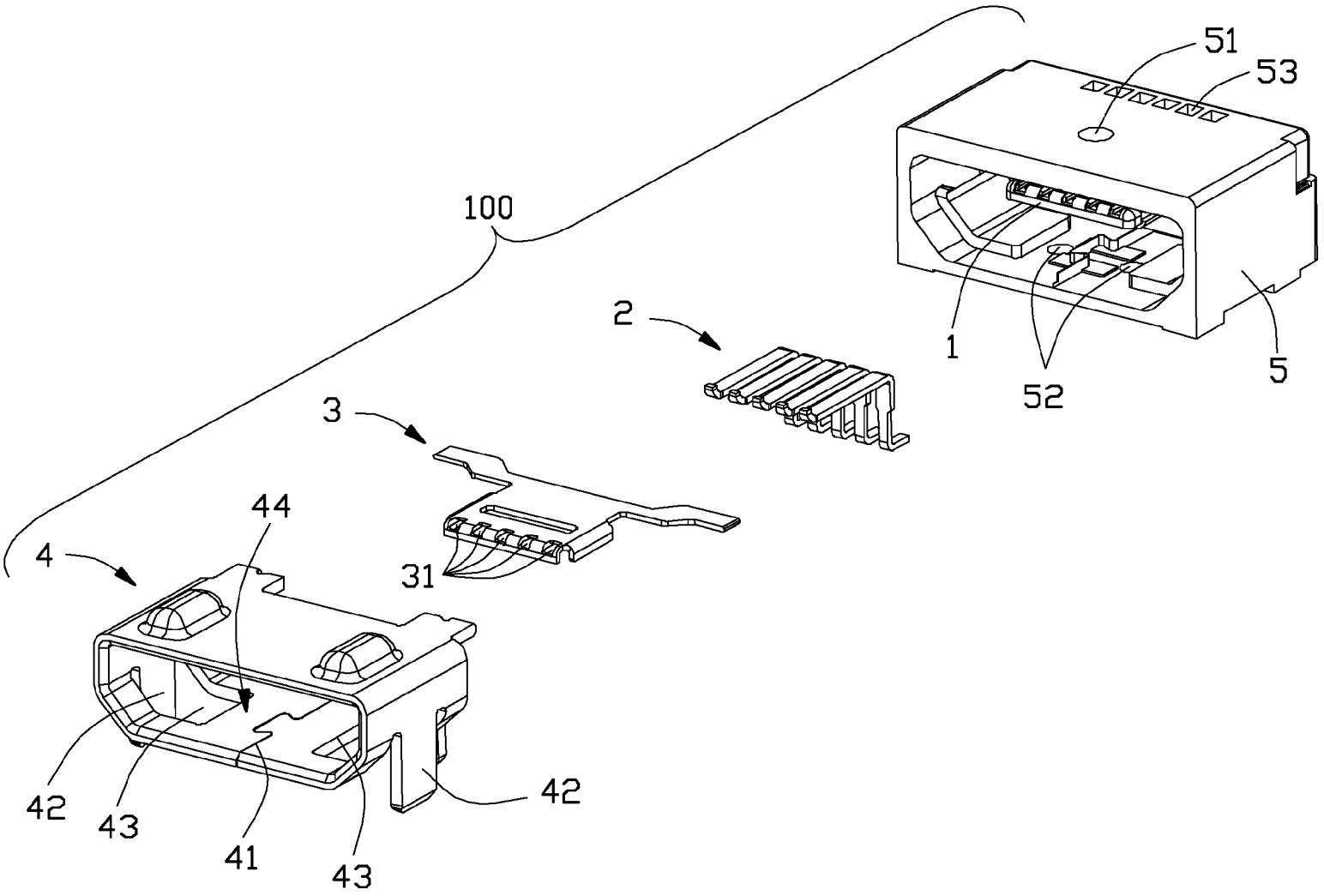
FIG. 2 is a perspective, exploded view of the electrical connector of FIG. 1.
Figure 3:
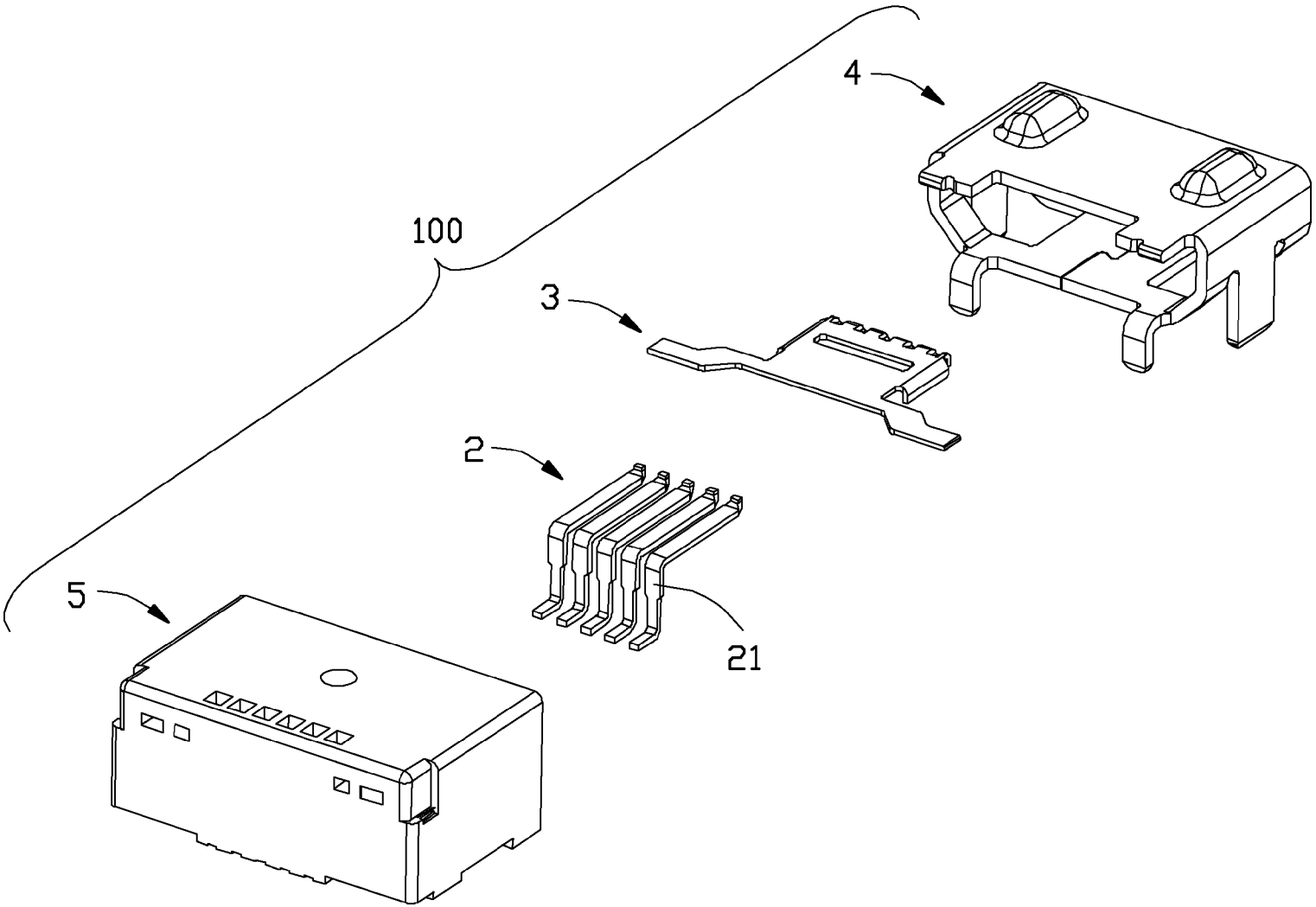
FIG. 3 is similar to FIG. 2, but taken from a different view.
Figure 4:
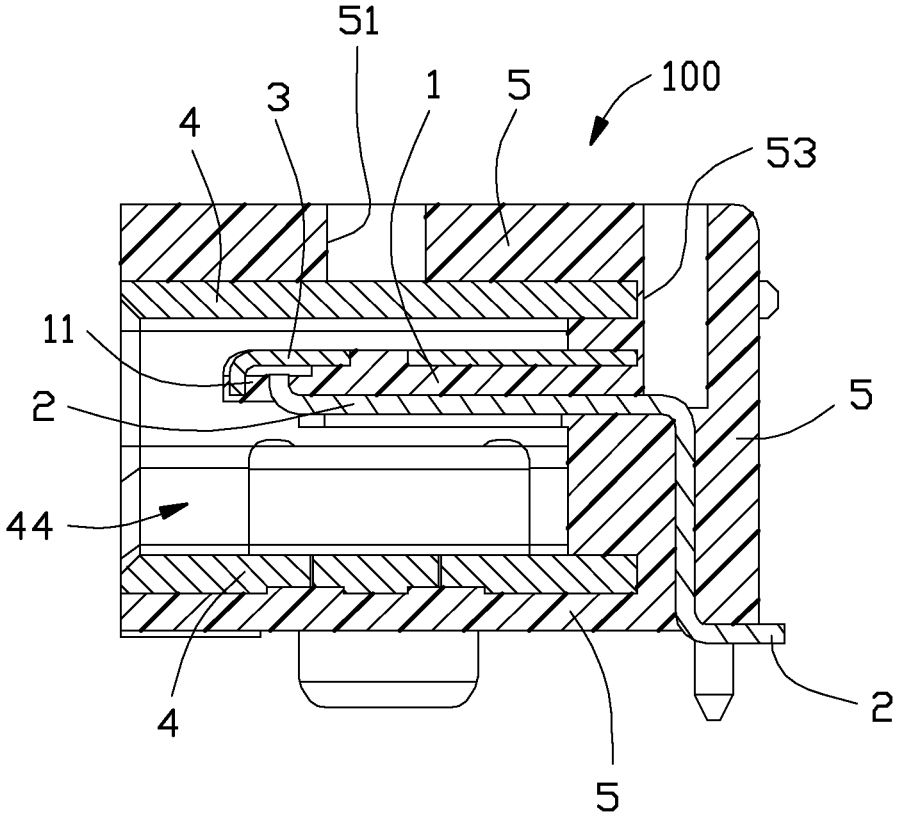
FIG. 4 is a cross-sectional view of FIG. 1 when taken along line 4-4.

Understandably, the instant invention uses both the first set of molds moveable along the front-to-back direction and the second set of molds moveable along a vertical direction perpendicular to the front-to-back direction for the so-called one shot insert-molding process. The round holes 51 and 52 in the cover 5 are used for receiving the second set of molds to hold the shell 4 in position during the insert-molding process. The rectangular holes 53 in the cover 5 are used for receiving the second set of molds to hold the contacts 2 in position during the insert-molding process. Understandably, there are six holes 53 corresponding five contacts 2, and it implies that each contact 2 is essentially located between two adjacent holes 53 while two lateral sides of the contact 2 are exposed under and within the holes 53 by two sides for being downward pressed by the second set of molds. On the other hand, the mating tongue 11 of the insulative housing 1 is made via the first set of molds wherein the holes 31 are used to retain the contacts 2 and the reinforcing metal plate 3 in position and away from each other during the insert-molding process for preventing shorting therebetween after made. Notably, the seam structure 41 of the shell 4 may be filled with the material of the cover 5 along with the associated diffusion layer 6 as shown in FIG. 2. In this embodiment, the mounting legs 42 of the shell 4 are stamped therefrom to form the corresponding through openings 43 which are filled with the material of the insulative cover 5 after the insert-molding process so as to restrain relative movement between the shell 4 and the cover 5 along the front-to-back direction. Similarly, the shell 4 forms a transverse slot (not labeled) located behind the holes 31 and filled with the insulative material of the mating tongue 11 after the insert molding process for preventing the horizontal relative movement between the reinforcing plate 3 and the mating tongue 11 of the insulative housing 1

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical connector comprising:

an insulative housing;

a plurality of contacts retained in the insulative housing;

a metal shell covering the insulative housing; and an insulative cover molded over the metal shell and integral with the insulative housing; wherein a diffusion layer in which chemical reaction is generated from metal and resin, is formed between the metal shell and the insulative cover, wherein the diffusion layer is formed between the contacts and the insulative housing and between the metal shell and the insulative housing, further comprising a reinforcing metal plate and wherein the diffusion layer is formed between the reinforcing metal plate and the insulative housing and between the reinforcing metal plate and the insulative cover, wherein the diffusion layer is formed by diffusion under a TRI Composite Technology because an electrochemical special metal surface treatment is implemented on the metal shell, the retaining portions of the contacts, and the reinforcing metal plate before insert injection molding.

2. The electrical connector as claimed in claim 1, wherein the shell includes a dovetailed seam with the insulative cover and the associated diffusion layer therein.

3. The electrical connector as claimed in claim 1, wherein the shell includes a pair of mounting legs stamped out therefrom to form a pair of through openings filled with material of the insulative cover.

4. The electrical connector as claimed in claim 1, wherein the insulative cover forms a plurality of molding holes for retain the contacts and the shell in position during an insert-molding process.

5. A method of making a waterproof electrical connector, comprising steps of:

providing a frame-like metallic shell with a receiving space therein;

providing a plurality of contacts within the receiving space;

providing a metallic reinforcing plate located within the receiving space spaced from the plurality of contacts;

providing a surface treatment upon at least said shell; and applying insulative material upon said metallic shell, said contacts and the reinforcing plate via a one shot insert-molding process; wherein a diffusion layer with mixed metal and insulative material is formed between the insulative material and the shell where the surface treatment is applied, wherein the diffusion layer is formed between the contacts and the insulative housing and between the metal shell and the insulative housing, further comprising a reinforcing metal plate and wherein the diffusion layer is formed between the reinforcing metal plate and the insulative housing and between the reinforcing metal plate and the insulative cover, wherein the diffusion layer is formed by diffusion under a TRI Composite Technology because an electrochemical special metal surface treatment is implemented on the metal shell, the retaining portions of the contacts, and the reinforcing metal plate before insert injection molding.

6. The method as claimed in claim 5, wherein the surface treatment is further applied upon the reinforcing plate.

7. The method as claimed in claim 5, wherein the surface treatment is further applied upon the contacts.

8. The method as claimed in claim 5, wherein said shell forms a dovetailed seam filled with the insulative material and the associated diffusion layer.

9. The method as claimed in claim 5, wherein said shell forms a pair of mounting legs stamped therefrom to form a pair of through openings filled with the insulative material after the insert molding process.

10. The method as claimed in claim 5, wherein the insulative material forms the housing essentially located within the shell and including a mating tongue extending along a front-to-back direction in the receiving space, and a cover surrounding the shell, said housing and said cover being unitarily formed via said one shot insert-molding process.

11. The method as claimed in claim 10, further including a step of providing a first set of molds moveable along the front-to-back direction to make the mating tongue, and a second set of molds moveable along a vertical direction perpendicular to said front-to-back direction, to make the cover.

12. A waterproof electrical connector comprising:

a frame-like metallic shell defining therein a receiving space communicating with an exterior along a front-to-back direction;

an insulative housing enclosed within the shell and including a mating tongue extending within the receiving space along the front-to-back direction and defining thereon opposite first and second surfaces in a vertical direction perpendicular to said front-to-back direction;

an insulative cover enclosing the shell and unitarily formed with the housing via one shot insert-molding process;

a plurality of contacts retained by the housing via said one shot insert-molding process with corresponding contacting sections exposed upon the first surface of the mating tongue;

a metallic reinforcing plate retained to the housing and covering the second surface of the mating tongue; wherein among three metallic parts of the shell, the reinforcing plate and the contacts, at least one metallic part includes a surface treatment face to joined with the corresponding one of said insulative housing and said insulative cover with a diffusion layer therebetween for firm joining, wherein the diffusion layer is formed between the contacts and the insulative housing and between the metal shell and the insulative housing, further comprising a reinforcing metal plate and wherein the diffusion layer is formed between the reinforcing metal plate and the insulative housing and between the reinforcing metal plate and the insulative cover, wherein the diffusion layer is formed by diffusion under a TRI Composite Technology because an electrochemical special metal surface treatment is implemented on the metal shell, the retaining portions of the contacts, and the reinforcing metal plate before insert injection molding.

13. The waterproof electrical connector as claimed in claim 12, wherein the shell forms a dovetailed seam filled with insulative material of the cover with the associated diffusion layer.

14. The waterproof electrical connector as claimed in claim 12, wherein said cover includes a plurality of molding holes communicating with an exterior in said vertical direction to retain the shell and the contacts in position during the one-shot insert-molding process.

15. The waterproof electrical connector as claimed in claim 12, wherein said reinforcing plate includes in a front edge a plurality of molding holes communicating with an exterior in the front-to-back direction for separating the reinforcing plate and the contacts during the one shot insert-molding process.

16. The waterproof electrical connector as claimed in claim 12, wherein said cover includes a plurality of first molding holes communicating with an exterior in said vertical direction to retain the shell and the contacts in position during the one-shot insert-molding process; said reinforcing plate includes in a front edge a plurality of second molding holes communicating with said exterior in the front-to-back direction for separating the reinforcing plate and the contacts during the one shot insert-molding process.

17. The waterproof electrical connector as claimed in claim 12, wherein the shell includes a pair of mounting legs stamped therefrom to form a pair of through opening which are filled with material of the cover after the one shot insert-molding process for preventing relative movement between the cover and the shell in the front-to-back direction.

* * * * *